US007931097B2

(12) United States Patent
Cartwright

(10) Patent No.: US 7,931,097 B2
(45) Date of Patent: Apr. 26, 2011

(54) MICROWAVE LINKED LASER CONTROL SYSTEM, METHOD, AND APPARATUS FOR DRILLING AND BORING OPERATIONS

(76) Inventor: Jason Austin Cartwright, Honeoye Falls, NY (US)

( * ) Notice: Subject to any disclaimer, the term of this patent is extended or adjusted under 35 U.S.C. 154(b) by 131 days.

(21) Appl. No.: 12/238,571

(22) Filed: Sep. 26, 2008

(65) Prior Publication Data

US 2009/0085767 A1 Apr. 2, 2009

Related U.S. Application Data

(60) Provisional application No. 60/976,405, filed on Sep. 28, 2007.

(51) Int. Cl.
*E21B 47/12* (2006.01)

(52) U.S. Cl. ..... 175/45; 175/40

(58) Field of Classification Search ..... 166/40, 166/45, 11, 16, 24; 175/40, 45, 11, 16, 24
See application file for complete search history.

(56) References Cited

U.S. PATENT DOCUMENTS 4,506,745 A * 3/1985 Bjor ..... 175/45
4,818,049 A * 4/1989 Assenheim et al. ..... 385/35
6,616,244 B2 * 9/2003 Hakkinen ..... 299/1.05
6,732,816 B2 * 5/2004 Dimitroff ..... 175/45
7,159,654 B2 * 1/2007 Ellison et al. ..... 166/250.01
7,510,029 B2 * 3/2009 Gunsaulis et al. ..... 175/61
7,528,946 B2 * 5/2009 Gunsaulis ..... 356/241.3
2005/0040150 A1 * 2/2005 Denney et al. ..... 219/121.84
2006/0185899 A1 * 8/2006 Alft et al. ..... 175/24
2009/0192715 A1 * 7/2009 Gunsaulis et al. ..... 702/9
2010/0086359 A1 * 4/2010 Saleniemi ..... 405/138

* cited by examiner

*Primary Examiner* — William P Neuder
*Assistant Examiner* — Catherine Loikith
(74) *Attorney, Agent, or Firm* — Patent Technologies, LLC; Robert D. Gunderman, Jr.

(57) ABSTRACT

A laser control system and apparatus for guiding a drilling or boring operation during a trenchless technology implementation. In most if not all trenchless technology applications, direction of the pipe or utility structure through the earth is of utmost importance. Proper directional guidance throughout the trenchless technology implementation ensures not only that the resulting utility infrastructure is placed properly, but also ensures that the trenchless technology operation, does not hit or otherwise damage (such as through vibrations) existing utilities and other underground objects. The laser control system and apparatus of the present invention comprises a laser, a housing having a laser sight, a camera in optical communication with the laser sight a microwave transmitter having an antenna, with the transmitter being operatively coupled to the camera, and a microwave receiver.

13 Claims, 6 Drawing Sheets

MICROWAVE LINKED LASER CONTROL SYSTEM, METHOD, AND APPARATUS FOR DRILLING AND BORING OPERATIONS

CROSS-REFERENCE TO RELATED PATENT APPLICATIONS

This application claims the benefit of the filing date of U.S. Provisional Patent Application No. 60/976,405 filed on Sep. 28, 2007.

BACKGROUND OF THE INVENTION

1. Field of the Invention

This invention relates generally to control systems for drilling and boring operations, and more particularly to a microwave linked laser control system and apparatus for drilling and boring operations.

2. Description of Related Art

Trenchless technology is a growing field that includes a wide variety of methods and techniques for installing and rehabilitating underground infrastructure with minimal surface disruption and without the destruction and subsequent rebuilding of essential infrastructure that is common with trenching and excavation. Examples of trenchless technologies include, but are not limited to, microtunneling, pipejacking, pipe ramming, sliplining, guided boring, haul systems, tunnel boring, and earth pressure balance systems.

In most if not all trenchless technology applications, direction of the pipe or utility structure through the earth is of utmost importance. Proper directional guidance throughout the trenchless technology implementation ensures not only that the resulting utility infrastructure is placed properly, but also ensures that the trenchless technology operation does not hit or otherwise damage (such as through vibrations) existing utilities and other underground objects.

In some trenchless technology operations such as microtunneling and guided boring, the boring or tunneling tool can be guided during the operation itself by various techniques. In other trenchless technology operations, such as pipejacking and pipe ramming, the method is often non-steerable, and pipes installed by these methods are laid straight. Often times a pilot tube is placed prior to the pipejacking or pipe ramming operation using a technique such as microtunneling. The subsequent pipejacking or pipe ramming operation will then follow the pilot tube to ensure that the pipe is installed in its proper location.

In guiding a trenchless technology operation, knowledge of when the cutting head is deviating from its intended course is extremely valuable so that the machine operator can make adjustments necessary to bring the direction of the cutting head back on course. The cutting head may deviate from its intended course for a variety of reasons, such as machine or operator inputs, encounter of different soil types, encounter of a rock or boulder, and the like. Knowing when such a deviation occurs and the extent of such a deviation is important to ensure that timely course corrections are made.

It is an object of the present invention to provide a microwave linked laser control system and apparatus for drilling and boring operations. It is another object of the present invention to provide a microwave linked laser control system and apparatus for drilling and boring operations where the control head guidance system is linked to an operator location by way of microwave communications. It is a further object of the present invention to provide a microwave linked laser control system and apparatus for drilling and boring operations where the laser control system can be remotely perceived. It is a further object of the present invention to provide a microwave linked laser control system and apparatus for drilling and boring operations that can optionally be operated remotely. It is yet another object of the present invention to provide a microwave communications link that operates below ground. It is another object of the present invention to provide a microwave communications link that operates within the confines of a drill or bore hole. It is another object of the present invention to provide a microwave linked laser control system and apparatus that operates below ground. It is yet another object of the present invention to provide a microwave linked laser control system and apparatus that operates within the confines of a drill or bore hole.

BRIEF SUMMARY OF THE INVENTION

In accordance with the present invention, there is provided a laser control system and apparatus for drilling and boring operations comprising a laser, a housing having a laser sight, a camera in optical communication with said laser sight, a microwave transmitter having an antenna, said transmitter being operatively coupled to the camera, and a microwave receiver.

The foregoing paragraph has been provided by way of introduction, and is not intended to limit the scope of the present invention as defined by this specification and the attached drawings.

BRIEF DESCRIPTION OF THE DRAWINGS

The invention will be described by reference to the following drawings, in which like numerals refer to like elements, and in which.

Figure 1:
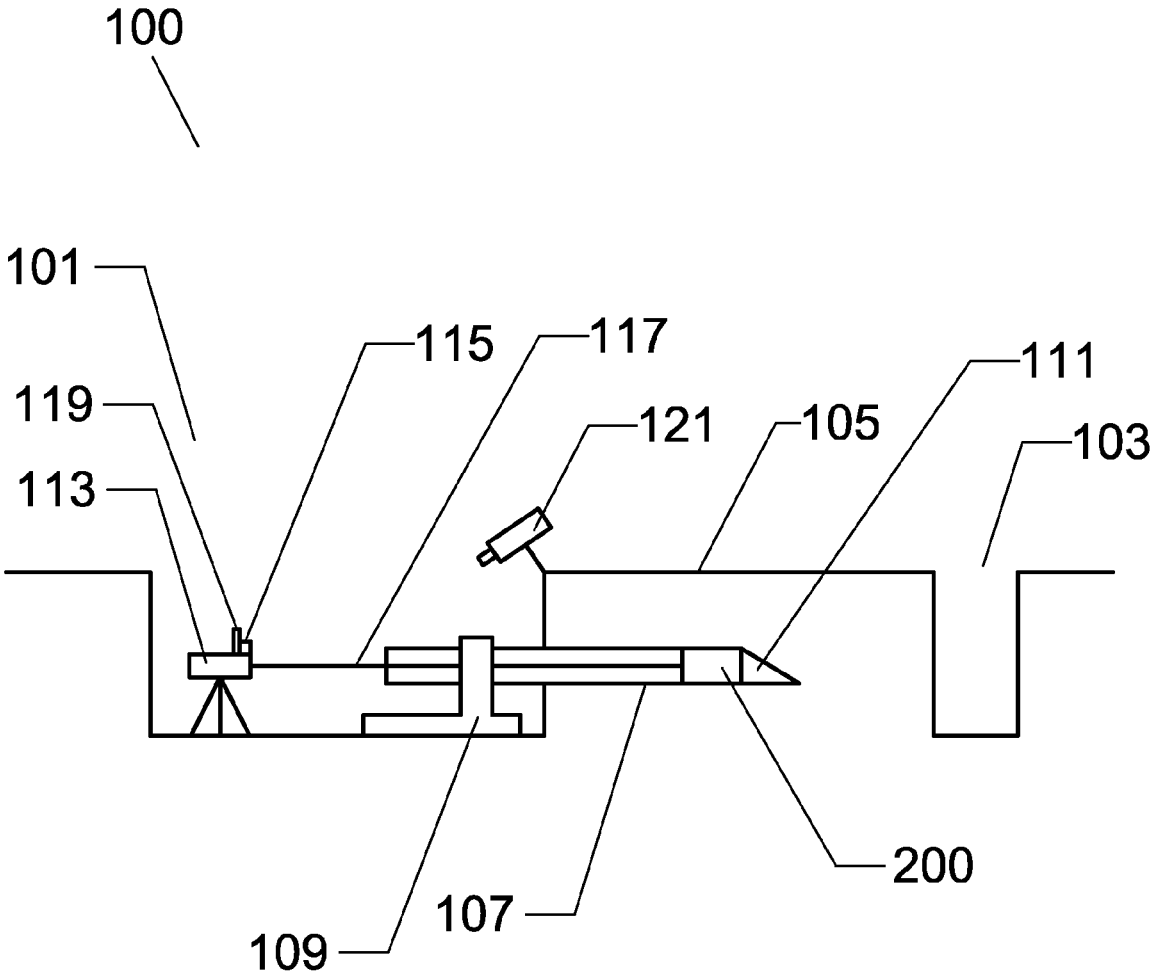
FIG. 1 is a diagram of a microwave linked laser controlled trenchless operation.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification, drawings, and claims.

DESCRIPTION OF THE PREFERRED EMBODIMENTS

For a general understanding of the present invention, reference is made to the drawings. In the drawings, like reference numerals have been used throughout to designate identical elements.

FIG. 1 is a diagram of a laser controlled trenchless operation. In a horizontal trenchless operation, it is common to have an insertion pit 101 and a receiving pit 103 that correspond with the origination and the termination of the trenchless operation or a segment thereof. The insertion pit 101 and the receiving pit 103 are typically excavated and often times reinforced for worker safety. If the trenchless operation is performed on a slope, one or both of the insertion pit 101 and the receiving pit 103 may not be necessary. An example of such an application is the trenchless installation of a culvert pipe under a raised railroad bed where trenchless technology is used to prevent settling or disruption of the railroad bed. The raised railroad bed has slopes on either side of the railroad bed that negate the need to excavate an insertion pit 101 or a receiving pit 103. FIG. 1 further shows the top of terrain 105. The laser controlled trenchless operation of FIG. 1 is exemplary only, and is not intended to limit the scope of the present invention to any particular type or method of trenchless technology. A pipe 107 is drilled from the insertion pit 101 to the receiving pit 103. The pipe 107 may be steel or other material suitable to drilling or boring operations, as will be known to those skilled in the art. The pipe 107 may be rotated and driven by a drive unit 109. Examples of such drive units are those units manufactured by Akkerman, Inc. of Brownsdale, Minn., and whose products can be seen at www.ackermann.com. The drive unit 109 provides rotation to the pipe 107 as well as horizontal displacement sufficient to progress the drilling or boring operation. At the far end of the pipe 107 is a pipe head 111 that serves to cut through soil as the pipe 107 is rotated and driven by the drive unit 109. In some embodiments of the present invention, the pipe head 111 is beveled to help guide placement of the pipe 107. An operator can control the yaw and pitch of the pipe 107 as it is being inserted through the ground. This control is performed by slowing or stopping the rotation of the pipe 107 at the drive unit 109 while maintaining or modifying the horizontal force applied to the pipe 107. Due to the geometry of the pipe head 111, the pipe 107 will tend to track on a linear course when rotation is applied from the drive unit 109, and will tend to track in a non-linear fashion when rotation from the drive unit is slowed down or stopped. This attribute is useful in controlling the direction of the pipe 107. Should the pipe 107 deviate from it's intended course during installation, the direction of the pipe 107 can be altered by slowing or stopping the rotation of the pipe 107, orienting the pipe head 111 such that the beveled surface of the pipe head provides non-linear tracking in the intended direction, and then resuming rotation of the pipe 107 once it is determined that the pipe 107 has returned to it's intended course during installation. The laser control system and apparatus of the present invention allows one to determine if the direction of travel of the pipe 107 has deviated from it's intended course during installation, and further, allows one to determine the angular position of the pipe head 111 such that course corrections can be made. The laser control system and apparatus of the present invention uses a control head 200 within or otherwise coupled to the pipe 107 to provide information to an operator regarding the direction of travel of the pipe 107 being installed and the angular position of the pipe head 111. The placement of the control head 200 may be centered within the pipe 107, offset within the pipe 107, or placed on the exterior of the pipe 107. The control head 200 may also be used in various underground operations by placement on an underground structure such as a tunnel wall, tunnel ceiling, bore hole, and the like. The placement of the control head 200 is commonly dictated by the specific underground operational objective to be met. A laser 113 originates a laser beam 117 through or otherwise past the drive unit 109, and down the length of pipe 107. Upon reaching the control head 200, the laser beam 117 strikes a laser sight 303 that is shown later in FIG. 3. As will be further explained in later description of the accompanying subsequent figures, the laser sight 303 contains crosshairs or other markings that are imaged by a camera, and sent by way of a microwave link to a microwave receiver 115 that is coupled to a display 119 attended by an operator. The image of the incident laser beam on the laser sight 303 in relation to the crosshairs or other markings on the laser sight 303 is thus used to determine the direction of the control head 200 during the boring or drilling operation, and also provides the operator with information on the deviation of travel of the pipe 107 during installation. This allows the operator to make minor course corrections throughout the installation process. It is important to know the angular position of the control head 200 so that the pipe head 111 can be rotated to the proper position to allow for travel in a specified direction. The laser sight 303 further contains a pivot mount and hole that will be later shown and explained by way of FIG. 3 that allows for the determination of angular position of the control head 200 by ensuring that the laser sight is always oriented in the same dimension as defined by gravity. As will be further explained later in this specification, the microwave link is novel and unique due to, among other things, its ability to provide uninterrupted microwave communications below ground, using a specialized directional antenna that further uses the pipe 107 as a waveguide of sorts.

In some embodiments of the present invention, a video camera 121 may be used to provide remote oversight of the drilling or boring operation.

During operation of the microwave linked laser control system and apparatus of the present invention, the laser sight 303 (not shown in FIG. 1, refer to FIGS. 3-6) is continuously monitored by way of the camera, microwave link, microwave receiver 115 and display 119, during a drilling or boring operation, and minor course deviations are corrected through operator intervention by slowing or stopping the rotation of the pipe 107, orienting the pipe 107 and attached pipe head 111 in an angular position that will allow the pipe head 111 to travel in a direction that will compensate for the detected course deviation, providing displacement of the pipe 107 and pipe head 111 until such time as the course is corrected, and then returning to rotational and horizontal displacement boring or drilling.

As will become evident to one skilled in the art after reading this specification and the attached drawings and claims, the microwave linked laser control system and apparatus of the present invention is well suited to a variety of trenchless operations, and also to vertical boring and drilling operations.

Figure 2:
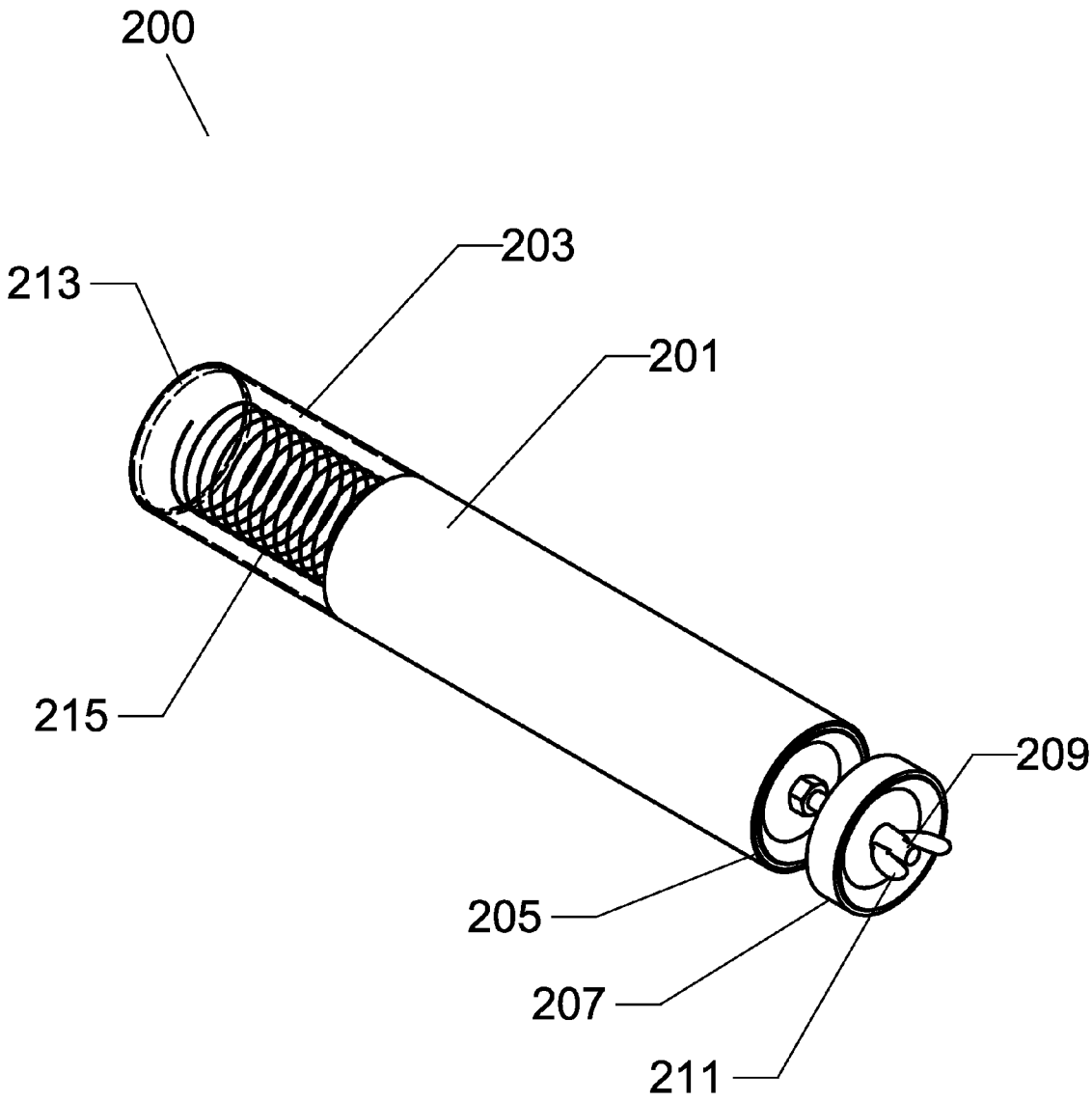
FIG. 2 is a perspective view of a microwave linked laser control head.

Turning now to FIG. 2, a perspective view of a microwave linked laser control head is shown. The control head 200, as previously described by way of FIG. 1, is used to control the direction of a boring or drilling operation through the use of a laser in combination with a microwave link. The control head 200 has a main housing 201 that contains the mechanical and electrical components that will be further described herein. The main housing 201 may be made from steel, copper, brass, stainless steel, carbon steel, plastic, reinforced plastic, fiberglass, or any material with adequate structural strength. A microwave housing 203 is also shown coupled to the main housing 201. The microwave housing 203 may be made from the same material as the main housing 201 if that material provides for sufficient radio transparent properties, or it may be made from a material that differs from the material of the main housing 201 if the main housing material does not provide for adequate radio transparent properties. The microwave housing 203 may be made from, for example, plastic, fiberglass, kevlar, glass, or any material that does not interfere with the radiation pattern of the antenna 215 contained within the microwave housing 203. The antenna 215 is a directional antenna sufficient to provide a microwave link down the length of the installed pipe 107 (see FIG. 1) to the microwave receiver 115 also shown in FIG. 1. The microwave receiver 115 and the microwave transmitter 313 (reference FIG. 3) operate at a frequency that is compatible with the diameter of the pipe 107 such that the pipe 107 operates as a waveguide. Such matching of operating frequency to pipe diameter is known to those skilled in the art, as the pipe is essentially acting as a waveguide. The microwave receiver 115 may also have, in some embodiments of the present invention, an axial mode helical antenna (not shown). This antenna may be operated in proximity to, or within, the confines of the pipe 107. This transmitter receiver setup may also, in some embodiments of the present invention, be set up with a relay point or relay system operating at the same or different frequency. The antenna 215 may, in some embodiments of the present invention, be a helical antenna, a ring antenna, or a modified ring antenna. The antenna 215 is made of a metal that is suitable for construction of a radio or microwave transmitting element. Such metals include, for example, aluminum, copper, steel, and the like. The end of the microwave housing 203 has an end cap 213 to keep debris, soil, moisture, and other detrimental materials out of the control head 200. The end cap 213 should be optically permeable to allow the laser beam 117 (as shown in FIG. 1) to traverse the microwave housing 203 and strike the laser sight 303 (as depicted in FIGS. 3-6). On the opposite end of the control head 200 is a first expandable plug 205, which seals the control head 200 from detrimental materials. Other techniques to seal the control head 200 may also be used without departing from the spirit and scope of the present invention as defined herein. A second expandable plug 207 is also shown along with a threaded shaft 209 and a tightener 211. The threaded shaft 209 and the tightener 211 may be made from a metal such as steel, brass, copper, stainless steel, or the like. The threaded shaft 209 and the tightener 211 may also be made from a plastic. The second expandable plug 207 may be made from a material such as rubber, silicone, or the like. The purpose of the expandable plug 207, tightener 211 and threaded shaft 209 is to attach the control head 200 to the inside of a pipe without allowing for rotation. While the second expandable plug 207, tightener 211 and threaded shaft 209 portray a specific embodiment, other attachment means may be used without departing from the spirit and scope of the present invention.

Figure 3:
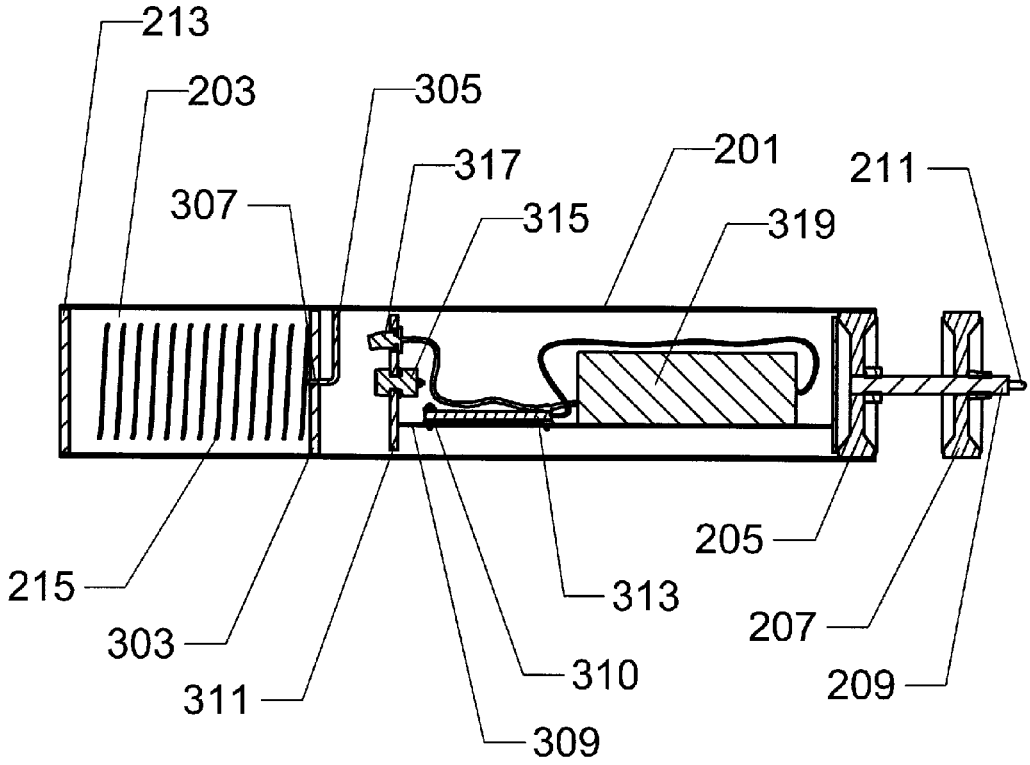
FIG. 3 is a side view of a microwave linked laser control head.

Turning now to FIG. 3, a side view of a microwave linked laser control head is shown. FIG. 3 shows the main housing 201 and the microwave housing 203, as described by way of FIG. 2. The microwave antenna 215, also described by way of FIG. 2, can be seen. The microwave antenna 215 is electrically coupled to a transmitter 313 (cabling not shown). The transmitter 313 operates, in one preferred embodiment of the present invention, in the microwave region of between about 300 Mhz. and about 300 Ghz. Microwave transmitters are known to those skilled in the art. Examples of microwave transmitters that can receive a video signal from a camera, for example, are the microwave transmitters manufactured by Advanced Microwave Products of Verdi, Nev. (www.advmw.com). The transmitter 313 is attached to a mounting surface 309 and may include shock isolation 310, such as a rubber grommet, o-ring, or the like. The transmitter 313 accepts an input from a camera 315, such as a CCD camera commonly used for viewing, security and surveillance. The camera 315 may be attached to a mount 311 that may also contain a light 317 such as, for example, a light emitting diode (LED) or LED array. The transmitter 313, camera 315, and light 317 are powered by a power source 319 such as a battery, an ultracapacitor, or a generator. The camera 315 is directed toward the laser sight 303. In use, the laser beam 117, as shown in FIG. 1, traverses the length of the pipe 107 and strikes the laser sight 303, providing a visible indicator such as a terminating dot or other such mark. The laser sight 303 is made from a material that allows the laser termination point to be viewed on the back side of the laser sight target 303 by the camera 315. An example of such a material is tinted polycarbonate, glass, Plexiglas, or the like. In some embodiments of the present invention, a diffuser, diffraction grating or other laser modifying structure may be used with the laser sight target 303 to improve the optical properties of the laser beam 117 and its associated terminating dot or mark. The laser sight target 303 also may contain markings or crosshatch indicators to assist in the guidance of the control head. The laser sight target 303 may also contain a hole 307 into which is inserted a pivot mount 305. The laser sight target can rotate about the pivot mount in such an arrangement, allowing for the laser sight target 303 to always be oriented in a given direction with respect to the gravity vector, thus accommodating the rotational aspects of the boring or drilling operation, and also, in some embodiments of the present invention, providing a further directional indicator for the operator.

Figure 4:
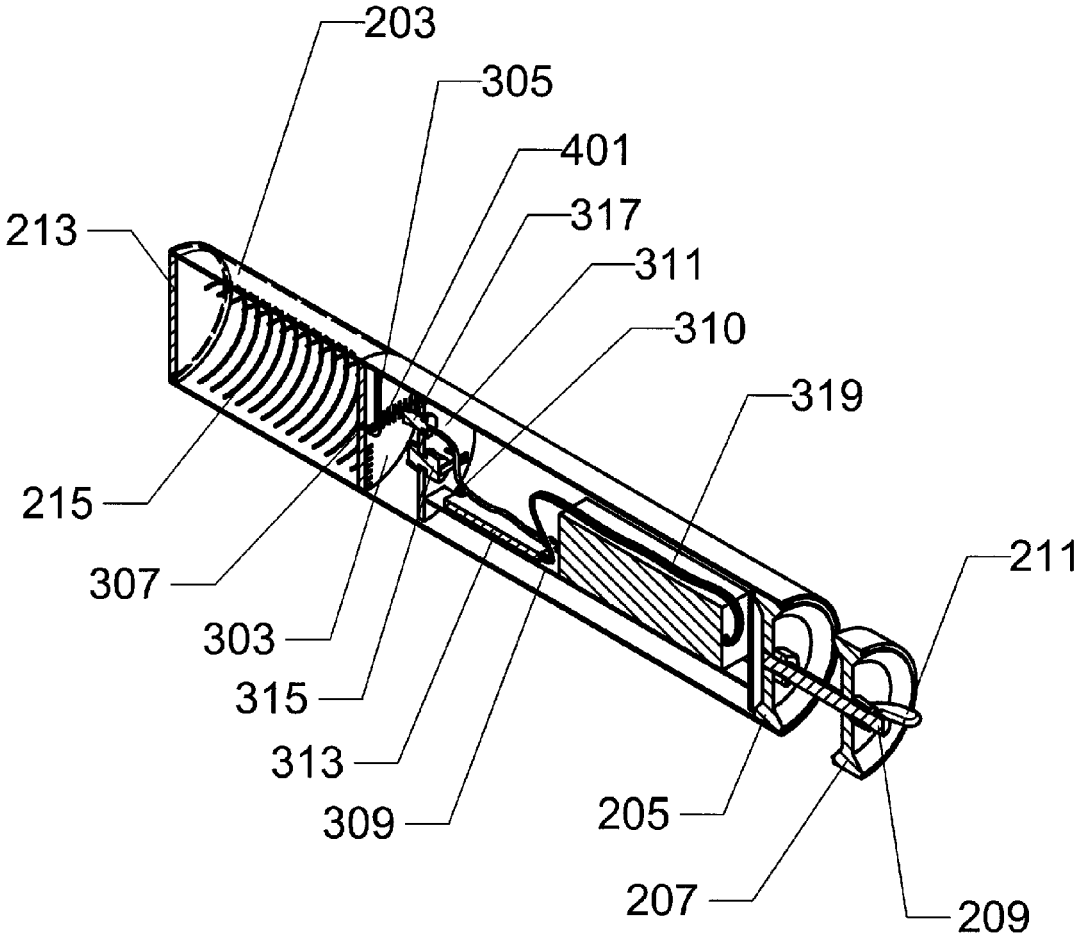
FIG. 4 is a lengthwise cutaway perspective view of a microwave linked laser control head.

Turning now to FIG. 4, a lengthwise cutaway perspective view of a microwave linked laser control head is shown. The components described by way of FIG. 3 can be clearly seen along with crosshair markings 401 on the laser sight 303. In other embodiments of the present invention, various forms of graduated markings, calibration markings, dots, lines, and the like may be used without departing from the spirit and scope of the present invention.

Figure 5:
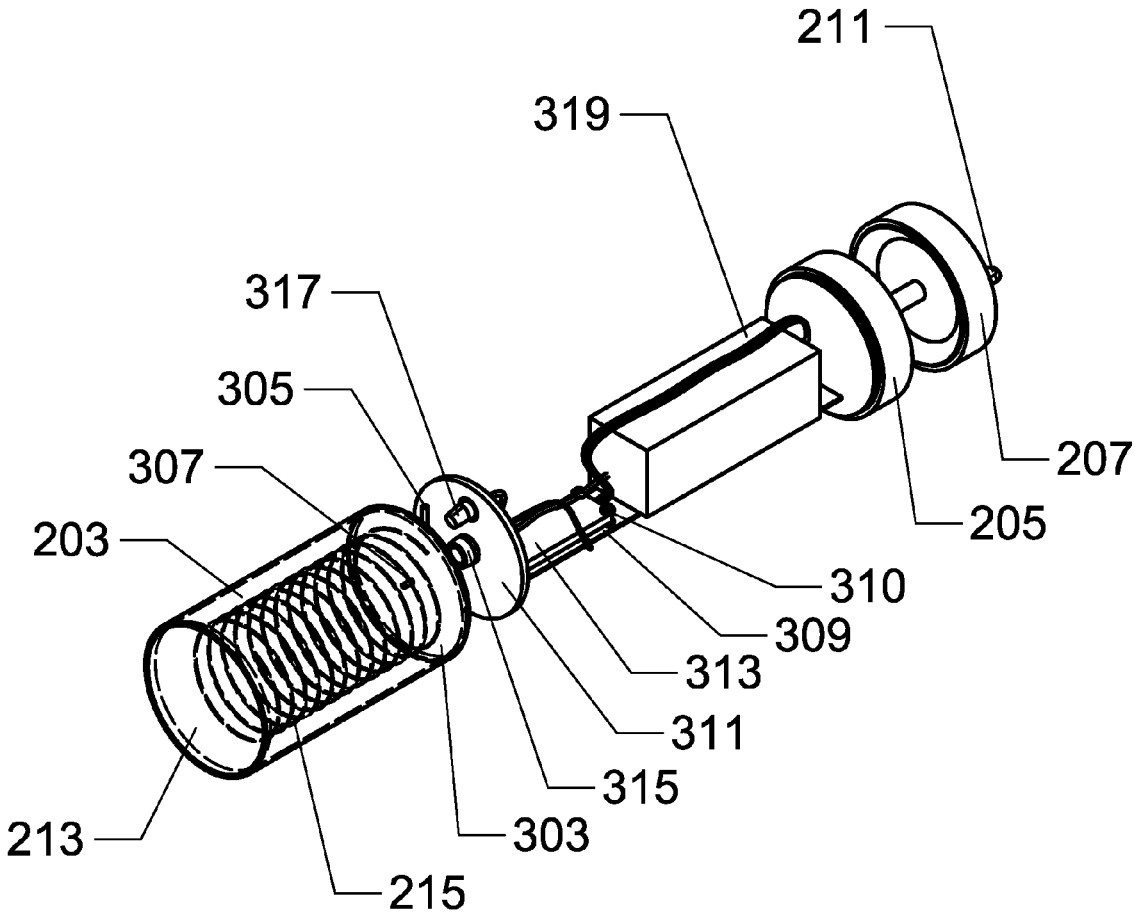
FIG. 5 is a perspective view of a microwave linked laser control head with the main housing removed.

FIG. 5 shows a perspective view of a microwave linked laser control head with the main housing 201 removed. The various components within the control head can be seen along with the pivot mount and hole arrangement for the laser sight 303.

Figure 6:
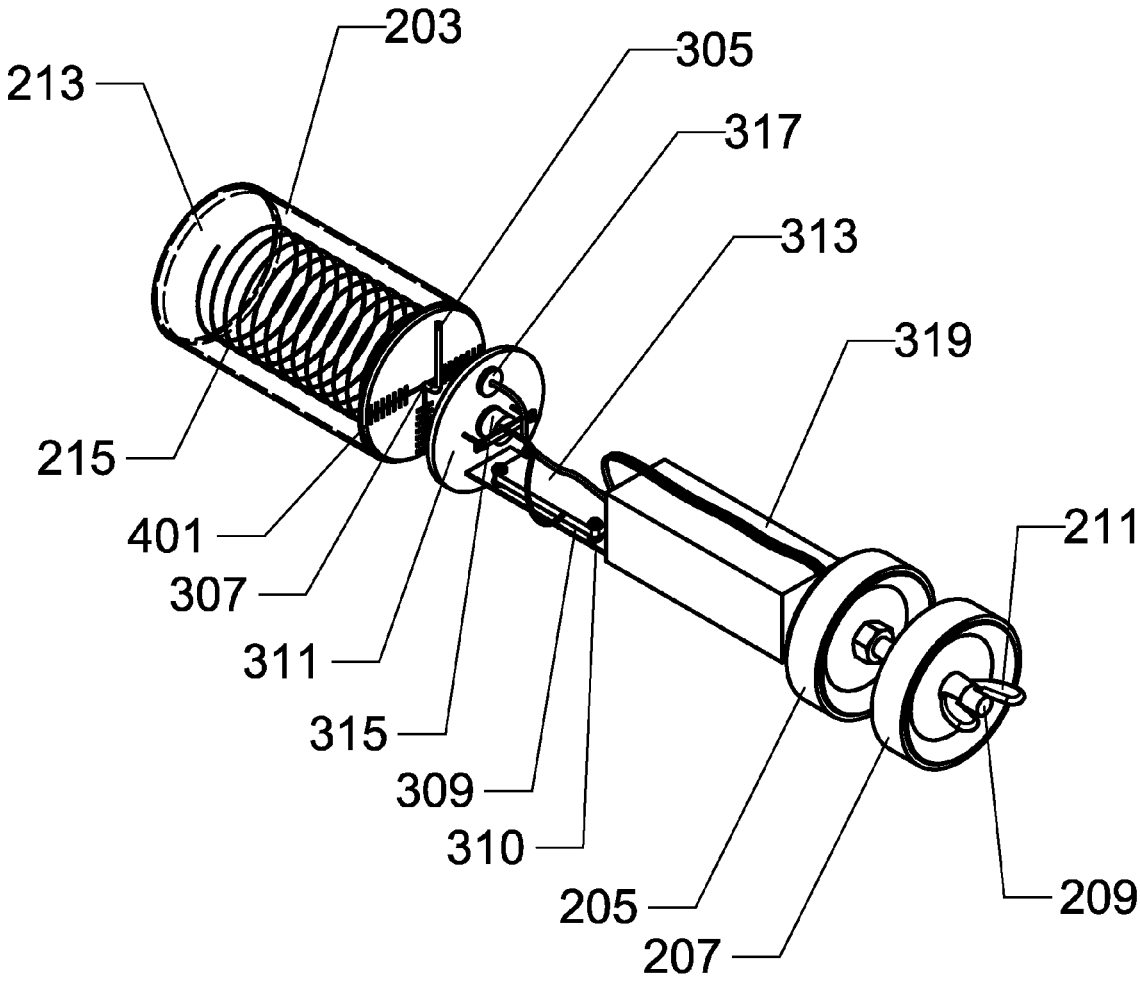
FIG. 6 is a second perspective view of a microwave linked laser control head with the main housing removed.

FIG. 6 shows a second perspective view of a microwave linked laser control head with the main housing removed. The view in FIG. 6 is rotated one hundred and eighty degrees with respect to the view depicted in FIG. 5. In both of these views, the various components within the control head can be seen from differing angles. The first expandable plug 205 and the second expandable plug 207 can be clearly seen, along with the threaded shaft 209 and tightener 211.

It is, therefore, apparent that there has been provided, in accordance with the various objects of the present invention, a microwave linked laser control system and apparatus for drilling and boring operations. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and attached drawings.

What is claimed is:

1. A microwave linked laser control system for drilling and boring operations comprising:

a drill pipe having a first end and a second end;

a laser located proximate to the first end of said drill pipe;

a housing located on the second end of said drill pipe and having a laser sight;

a camera in optical communication with said laser sight;

a microwave transmitter having an antenna, said transmitter being operatively coupled to the camera;

and a microwave receiver.

2. The microwave linked laser control system of claim 1, further comprising a pivot mount mechanically connected to said laser sight.

3. The microwave linked laser control system of claim 1, further comprising a light source for illuminating said laser sight.

4. The microwave linked laser control system of claim 3, wherein the light source is a light emitting diode.

5. The microwave linked laser control system of claim 1, further comprising a display for providing a visual image of the laser sight as seen by the camera.

6. The microwave linked laser control system of claim 1, further comprising an expandable plug for retaining the housing in a pipe.

7. The microwave linked laser control system of claim 1, further comprising a power source.

8. The microwave linked laser control system of claim 7, wherein the power source is a battery.

9. The microwave linked laser control system of claim 7, wherein the power source is a generator.

10. The microwave linked laser control system of claim 7, wherein the power source is an ultracapacitor.

11. The microwave linked laser control system of claim 1, wherein the antenna is a helical antenna.

12. The microwave linked laser control system of claim 1, wherein the antenna is a ring antenna.

13. A method for guiding a cutting head in a drilling or boring operation, the method comprising the steps of:

mechanically coupling a cutting head and a microwave linked laser control head;

rotating said cutting head;

directing a laser beam through a drill pipe and at a laser sight of the microwave linked laser control head;

creating an image of the laser beam incident upon said laser sight;

transmitting said image by way of a microwave transmitter to a microwave receiver;

reading said image by way of a display operatively coupled to said microwave receiver;

making directional adjustments to the drilling or boring operation based on reading said image.

* * * * *